United States Patent [19]

Fabre

[11] Patent Number: 5,031,670

[45] Date of Patent: Jul. 16, 1991

[54] YARN-GRIPPER DEVICES MOUNTED ON THE WEFT-PASSING MEMBER OF FIXED WEFT MAGAZINES

[76] Inventor: Aimé Fabre, La Pomatière, Brangues 38510, France

[21] Appl. No.: 492,911

[22] Filed: Mar. 13, 1990

[30] Foreign Application Priority Data

Mar. 17, 1989 [FR] France ..... 89 03793

[51] Int. Cl.[5] ..... D03J 5/06; D03D 47/24

[52] U.S. Cl. ..... 139/438; 139/194; 139/196.2

[58] Field of Search ..... 139/438, 194, 430, 439, 139/196.2

[56] References Cited

U.S. PATENT DOCUMENTS

| | | | |
|---|---|---|---|
| 3,592,241 | 7/1971 | Svaty | 139/438 |
| 3,717,181 | 2/1973 | Fabre | 139/438 |
| 4,858,657 | 8/1989 | Fabre | 139/430 X |

*Primary Examiner*—Andrew M. Falik

*Attorney, Agent, or Firm*—Dowell & Dowell

[57] ABSTRACT

A yarn-gripper device mounted on the weft-passing member in a weaving loom which includes a movable jaw element which pivots about a first axis against the action of an elastic element which urges the movable jaw to close with a fixed jaw to grip yarn therebetween and which also includes an effort reducing lever which pivots about a second axis located between the first axis and the elastic element and which lever is engagable with movable jaw to open the jaw against the elastic element.

4 Claims, 3 Drawing Sheets

YARN-GRIPPER DEVICES MOUNTED ON THE WEFT-PASSING MEMBER OF FIXED WEFT MAGAZINES

BACKGROUND OF THE INVENTION

1. Field of the Invention

The present invention relates to improvements in or relating to yarn-gripper devices mounted on the weft-passing member in weaving looms comprising fixed weft magazines.

2. History of the Related Art

In order to obtain large-width industrial fabrics made from yarns presenting a relatively large diameter combined with a certain rigidity, weaving looms of conventional type are known to be generally employed in which the weft-passing member is constituted by a false shuttle thrown through the shed by two lateral sticks. The looms are equipped with two fixed weft magazines and the false shuttle is provided with a yarn-gripping device adapted to grip the yarn of one of the magazines at the corresponding selvedge and to release it at the opposite selvedge.

A conventional yarn-gripper device is illustrated in FIG. 1 of the accompanying drawings. The yarn-gripper device generally comprises a small frame 1 which is fixed against the lower face of the false shuttle 2 and which extends laterally on the side thereof opposite the batten of the loom. On a pivot 3 oriented parallel to the axis of the false shuttle 2, there is articulated a jaw element 4 of complex profile, adapted to define in cross-section:

a mobile jaw 4*a* adapted to cooperate with a fixed jaw l*a* provided on frame 1;

a flange 4*b* facing away from jaw 4*a* and subjected to the elastic action of vertical pushers 5 which tend to apply the jaw 4*a* continuously against jaw l*a;* and a vertical actuation heel 4*c* housed with clearance inside a longitudinal groove 2*a* in the body of the false shuttle 2.

The device is opened with the aid of one or the other of two shoes 6 fixed on the sides of the loom and sectioned so as to engage in the groove 2*a* in the false shuttle and thus to bear against heel 4*c*. The whole of the jaw element 4 subsequently pivots about pivot 3 against the elastic pushers 5, which has for its effect momentarily to move jaw 4*a* away from jaw l*a* and to release the weft yarn which was gripped therebetween.

It will be readily appreciated that, in order to ensure efficient gripping despite the resistance to unwinding exerted by the yarn, it is necessary to associate very powerful springs 7 with the pushers 5. Under these conditions, it is clear that the effort that each shoe 6 must exert on heel 4*c* is very great, which results, on the one hand, in the false shuttle being considerably slowed down in its stroke, and, on the other hand, in rapid wear of the shoes.

SUMMARY OF THE INVENTION

It is a principal object of the present invention to overcome these drawbacks, essentially by associating with the jaw element an independent pivoting lever which, receiving the action of the fixed control shoes, transmits force to the jaw element with less effort.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 2:
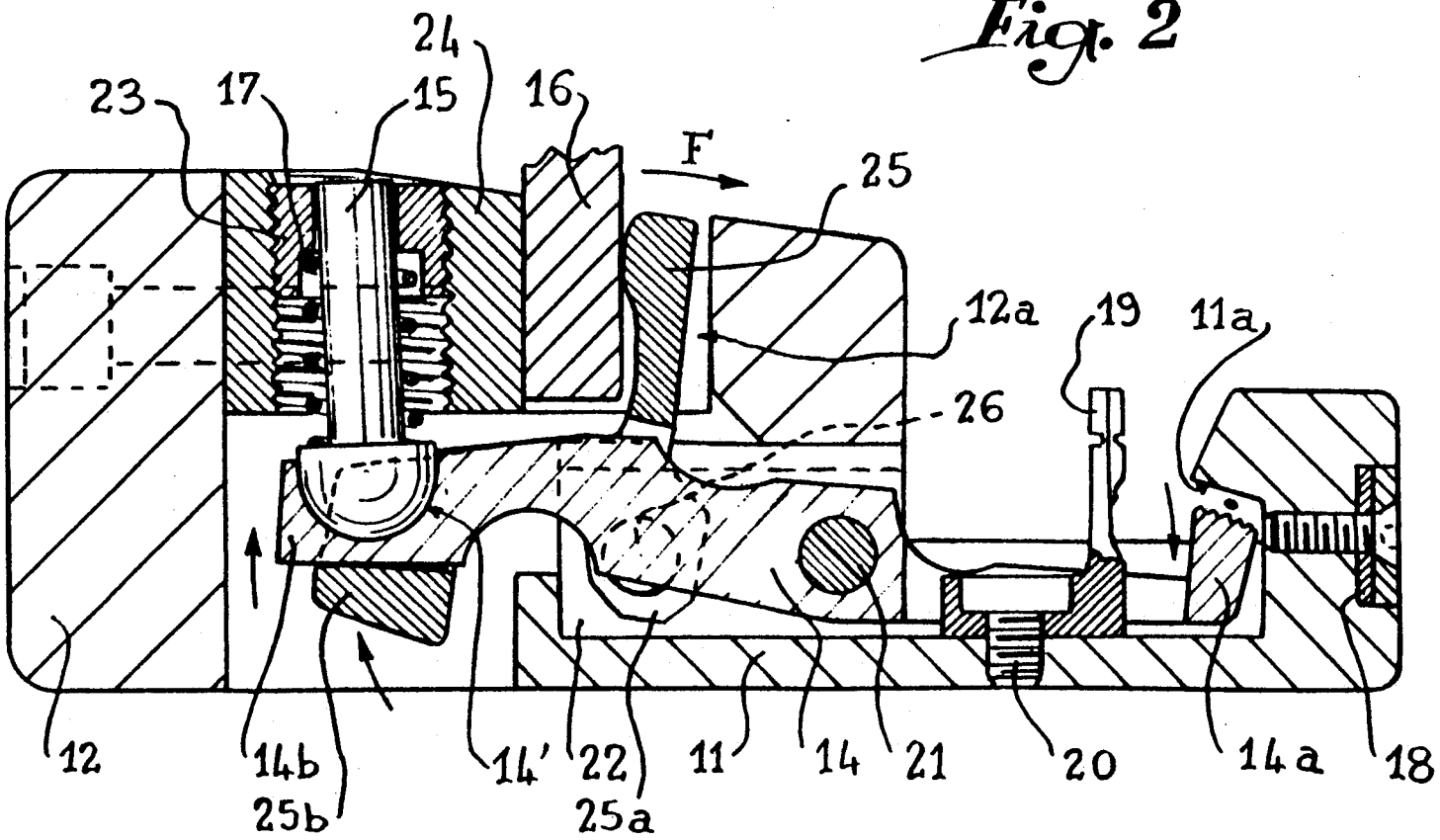
FIG. 2 is a transverse section showing the arrangement of a device improved in accordance with the present invention.

Referring again to the drawings, FIG. 2 shows at 12 the body of the false shuttle against the lower face of which is connected a frame 11 in the form of a sole which projects laterally to form a fixed jaw 11*a*, oriented obliquely downwardly. The wall of frame 11 which projects laterally from the body 12 of the shuttle is provided, in conventional manner, with a blade or cutter 18 for cutting the weft yarn, while a conventional catch 19 is provided, fixed to the frame 11 by screws such as 20 to ensure control of the fixed lateral clamps used for maintaining each pick under tension.

Figure 3:
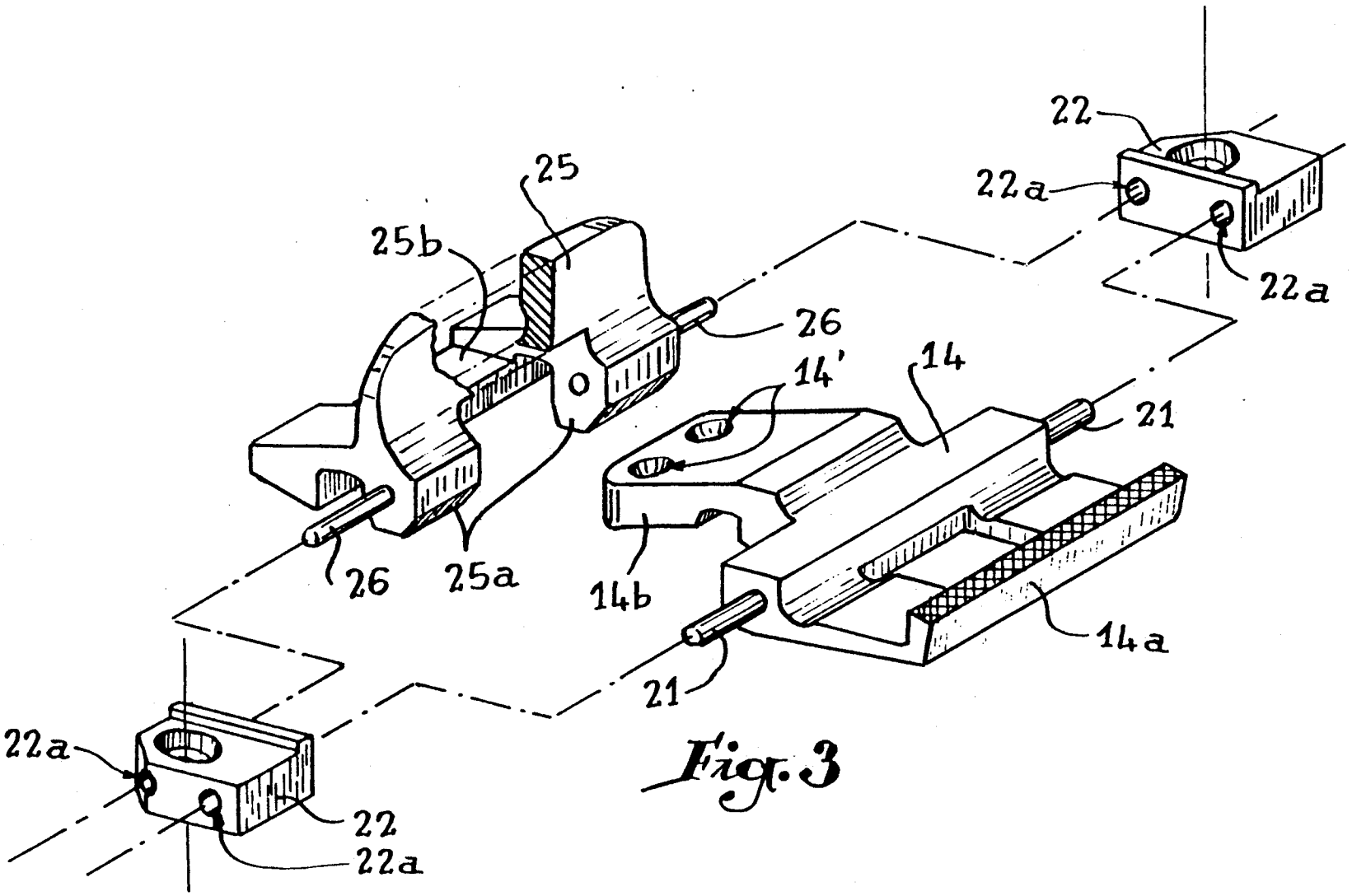
FIG. 3 is a perspective assembly view showing the different elements constituting the device according to FIG. 2.

The yarn-gripper device according to the invention conventionally comprises a pivoting jaw element 14 which, as illustrated in FIG. 3, is secured to two shafts 21 oriented longitudinally with respect to the axis of the shuttle which form pivots for the jaw element. In fact, each of these shafts 21 which are is engaged for rotation in one of two perforations 22*a* made side by side in blocks 22 fitted against the body of the shuttle 12 in order to allow the jaw element 14 to pivot.

Figure 1:
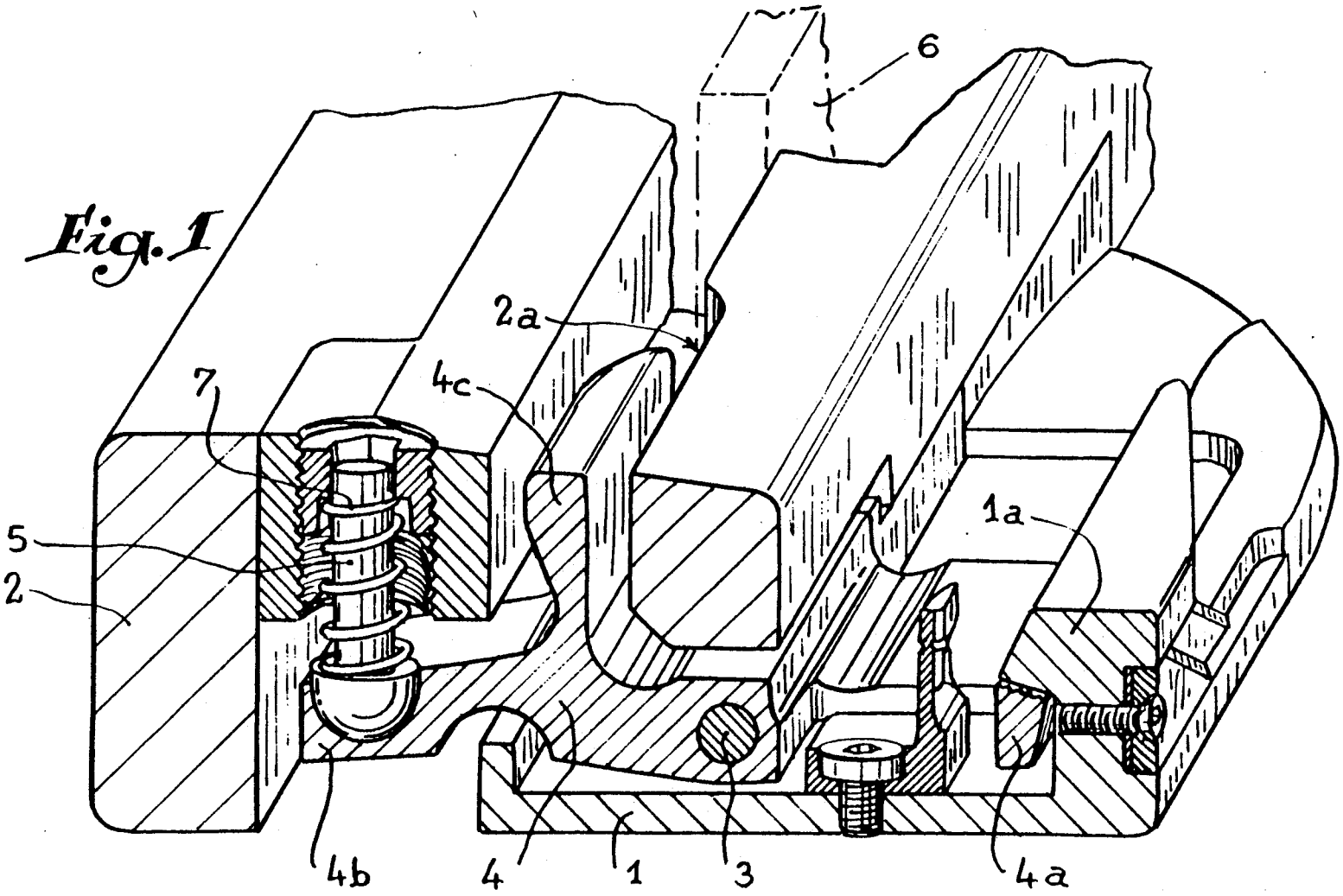
Fig. 1 PRIOR ART
FIG. 1 illustrates a conventional arrangement of a yarn-gripper device mounted on a false shuttle.

In the same manner as in FIG. 1, the jaw element 14 includes a movable jaw 14*a* adapted to cooperate with the fixed jaw 11*a* mentioned above. Opposite jaw 14*a*, the jaw element 14 has a flange 14*b* which presents recesses 14' adapted to cooperate with the head of pushers 15, two of which are shown. Each pusher 15 slides in a threaded bush 23 screwed in a vertical tapping of a longitudinal guide 24 which borders on one side the groove 12*a* of the body 12 of the false shuttle. Between the end of each bush 23 and the flared head of the corresponding pusher 15, there is interposed a spring 17 which tends to maintain the jaw 14*a* applied against the fixed jaw 11*a*.

Contrary to the conventional arrangement illustrated in FIG. 1, the jaw element 14 does not comprise any actuation heel (such as shown at 4*a* in FIG. 1). The heel is replaced by the vertical flange of a lever 25 with a section in the form of an angle iron which, as shown in FIG. 3, is provided with two shafts or pivots 26 engaged in the second of the perforations 22*a* of each block 22, with the result that the pivots 26 are placed between the pivots 21 of the jaw element 14 and the recesses 14' indicated above. This lever 25 is thus capable of pivoting about an axis parallel to that of the jaw element 14 independently thereof.

It should be observed that the shaft ends 26 are carried by lateral bosses 25*a* of the lever 25, between which bosses is engaged the flange 14*b* of the jaw element 14. This flange 14*b* thus bears against a web 25*b* which joins the two bosses 25*a* to each other, in the manner illustrated in FIG. 3, so that the effect of the lever 25 pivoting in the direction of arrow F of FIG. 2 is to provoke pivoting of the jaw element 14 and opening of the yarn-gripper device against the elastic return assembly 15–17.

Under these conditions, it will be readily appreciated that the general operation of the device according to the invention is per se identical to that of the conventional devices, in that, when the false shuttle comes to one or the other of its ends of stroke at the selvedges of the fabric, the corresponding fixed shoe 16 engages in the groove 12*a* and engages lever 25 which effects by pivoting the opening of jaws 14*a* and 11*a*. Nevertheless, the interposition of lever 25 between the shoe 16 shown and the jaw element 14, combined with the positioning of pivots 26 of the lever with respect to pivots 21 of the jaw element, introduces in the actuation system an effort reducing effect which allows easy control of opening of the device despite the resistance exerted on the jaw element by springs 17 associated with the pushers 15.

In other words, more powerful and efficient elastic elements may be used than in the prior art for retaining the weft yarn, without an adverse effect on the gripper device and with reduction in wear and tear of the components thereof.

It must, moreover, be understood that the foregoing description has been given only by way of example and that it in no way limits the domain of the invention which would not be exceeded by replacing the details of execution described by any other equivalents.

What is claimed is:

1. In a yarn-gripper device mounted on a weft-passing member of a weaving loom which includes fixed weft magazines and wherein the weft-passing member includes a longitudinal groove in which is slidably received fixed shoes of the loom, and wherein the gripper device includes a yarn engaging jaw mounted to the weft-passing member and a jaw element which is pivotably mounted about a first axis and which includes a movable jaw and an oppositely oriented outer flange having upper and lower surfaces and wherein the movable jaw is generally urged into clamping relationship with the fixed yarn engaging jaw by an elastic element which engages the upper surface of the outer flange of the jaw element on the opposite side of the first axis from the movable jaw, the improvement comprising, a lever means, pivot means for pivotably mounting said lever means about a second axis which is oriented between the first axis and the outer flange of the jaw element, said lever means including a first portion which extends into the longitudinal groove of the weft-passing member so as to be engagable with the fixed shoes and a second portion which abuts against the lower surface of the outer flange of the jaw element whereby as said first portion of said lever means is pivoted about said second axis by being engaged with the fixed shoes, said second portion thereof will urge the outer flange of the jaw element against the elastic element to open the movable jaw relative to the fixed yarn engaging jaw.

2. The yarn-gripper device of claim including a pair of oppositely oriented blocks mounted to the weft-passing member in spaced relationship to one another, a first and second opening in each block, the jaw element including oppositely oriented pivot shafts which are mounted within said first openings and said pivot means including a pair of oppositely oriented shafts carried by said lever means and which are mounted within said second openings.

3. The yarn-gripper device of claim 2 in which said first and second axes are parallel to one another.

4. The yarn-gripper device of claim 3 in which said shafts of said pivot means are carried by a pair of spaced lateral bosses, and the other flange of the jaw element extending between said lateral bosses.

* * * * *